US005642594A

United States Patent [19]

Sucre F

[11] Patent Number: 5,642,594

[45] Date of Patent: *Jul. 1, 1997

[54] PREFABRICATED BUILDING SYSTEM

[76] Inventor: Alfredo Sucre F, Calle Altagracia, Res. Las Tabaqueras, Torre 2, Apt. 1-A, Sector Sorocaima, La Trinidad, Caracas, Venezuela

[ * ] Notice: The portion of the term of this patent subsequent to Oct. 5, 2013, has been disclaimed.

[21] Appl. No.: 320,422

[22] Filed: Oct. 5, 1994

Related U.S. Application Data

[63] Continuation-in-part of Ser. No. 132,095, Oct. 5, 1993, Pat. No. 5,513,473.

[51] Int. Cl.[6] ..... E04C 2/08

[52] U.S. Cl. ..... 52/270; 52/272; 52/280; 52/282.2; 52/281; 52/584.1; 52/587.1; 52/580

[58] Field of Search ..... 52/270, 271, 272, 52/277, 578, 281, 588.1, 479, 282.2, 282.3, 284, 580, 584.1, 586.2, 587.1

[56] References Cited

U.S. PATENT DOCUMENTS

| | | | |
|---|---|---|---|
| 3,768,222 | 10/1973 | Birum, Jr. | 52/282 |
| 3,774,362 | 11/1973 | Matuschek et al. | 52/280 |
| 4,030,262 | 6/1977 | Dean | 52/587.1 |
| 4,967,531 | 11/1990 | Giles et al. | 52/587.1 |
| 4,989,386 | 2/1991 | Collis | 52/584.1 |
| 5,105,594 | 4/1992 | Kirchner | 52/239 |
| 5,247,773 | 9/1993 | Weir | 52/586.2 X |
| 5,486,391 | 1/1996 | Tyner | 52/586.2 X |

FOREIGN PATENT DOCUMENTS

| | | |
|---|---|---|
| 0051319 | 5/1982 | European Pat. Off. . |
| 0089443 | 9/1983 | European Pat. Off. . |
| 0121031 | 10/1984 | European Pat. Off. . |
| 0188583 | 7/1986 | European Pat. Off. . |
| 0193571 | 9/1986 | European Pat. Off. . |
| 0210116 | 1/1987 | European Pat. Off. . |
| 0235033 | 9/1987 | European Pat. Off. . |
| 337032 | 1/1968 | Spain . |
| 335441 | 2/1968 | Spain . |
| 333078 | 3/1968 | Spain . |
| 360591 | 11/1968 | Spain . |
| 351465 | 12/1969 | Spain . |
| 411974 | 1/1976 | Spain . |

(List continued on next page.)

OTHER PUBLICATIONS

R–Control Panel Building System —From 1991 Sweet's Homebuilding/Remodeling Catalog File, McGraw Hill.

Steelox Hardwall Building System, TW–100 Wall Pane, and Design–Line Wall Panel System —brochure sent to applicant by US Brick/Real Brick on Aug. 21, 1993.

Panelized Brick Wall System for Architectural Applications by Bonitz Mfg./US Brick., Inc. —brochure sent to applicant by US Brick/Real Brick on Aug. 21, 1993.

*Primary Examiner*—Wynn E. Wood

*Attorney, Agent, or Firm*—Fish & Neave; Jeffrey H. Ingerman; Garry J. Tuma

[57] ABSTRACT

A prefabricated building system having a variety of structural bearing panels/frames shaped and designed for direct interconnection with one another. Each panel has an upper stud and a lower stud joined by at least one vertical stud. Only one vertical stud is used if the panel is to be joined, along the vertical edge that lacks a vertical stud, to another panel. The vertical edge having a vertical stud may or may not be interconnected to another panel. If the vertical stud is to be joined to the vertical stud of another panel, that stud must be designed for direct connection with that other panel. One such vertical stud is "⊔" or "[ ]" shaped, carrying male connection elements for interconnection along the edge of a panel that does not have a vertical stud. The connection elements may also be carried by the upper stud, the lower stud, or by both the upper and the lower stud. Another such vertical stud is "V" or "▽" shaped, and typically is used for perpendicular connection with a similarly shaped stud along the converging sides, i.e., the faces of the "V" portion. The panels have empty space left between the studs to allow for later insertion of insulation material or other construction materials.

22 Claims, 17 Drawing Sheets

FOREIGN PATENT DOCUMENTS

| | | |
|---|---|---|
| 429404 | 1/1977 | Spain . |
| 435057 | 1/1977 | Spain . |
| 243836 | 11/1979 | Spain . |
| 487268 | 3/1981 | Spain . |
| 497850 | 5/1982 | Spain . |
| 506457 | 9/1982 | Spain . |
| 537352 | 6/1986 | Spain . |
| 9101239 | 12/1991 | Spain . |
| 83-1775 | of 1983 | Venezuela . |
| 89-0790 | 5/1989 | Venezuela . |
| 90-1657 | 10/1990 | Venezuela . |

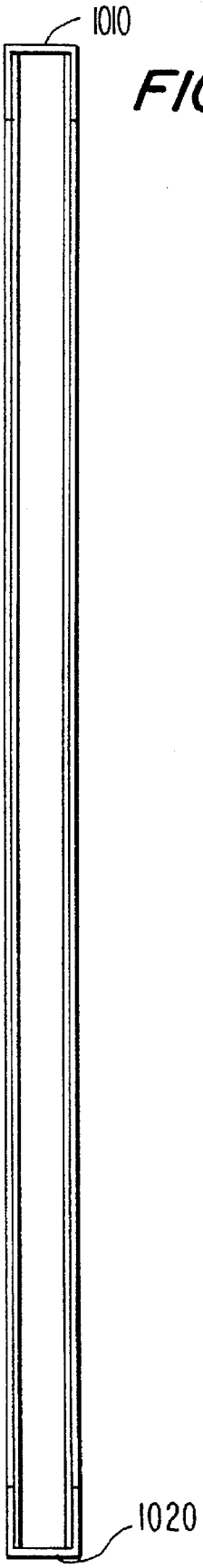
FIG.12
FIG.13
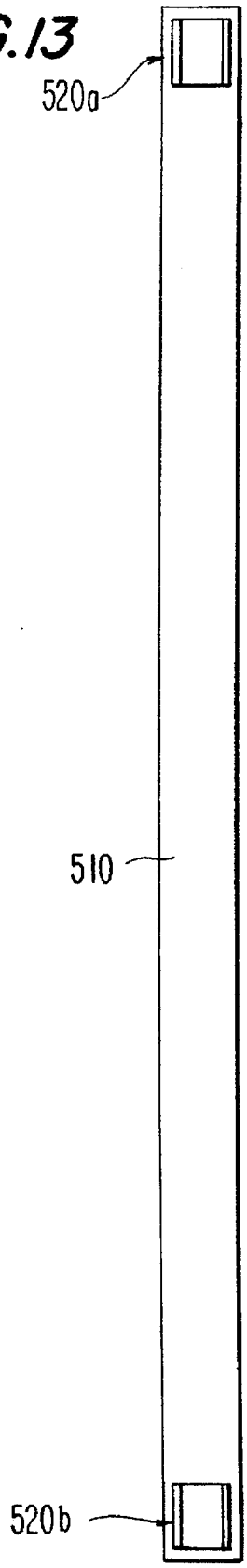

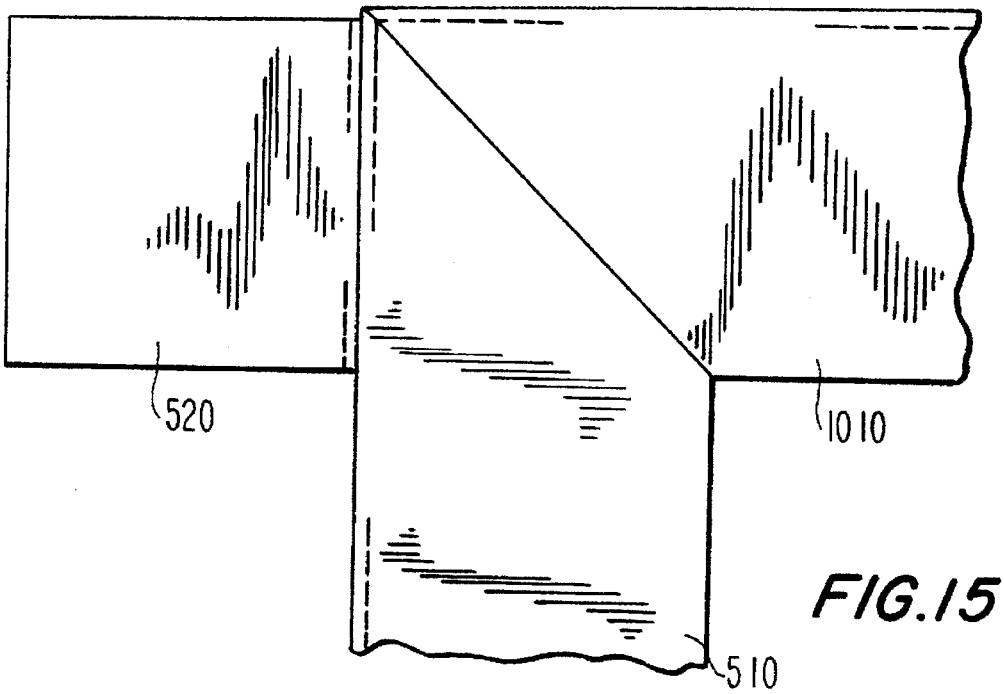
FIG.15
FIG.16
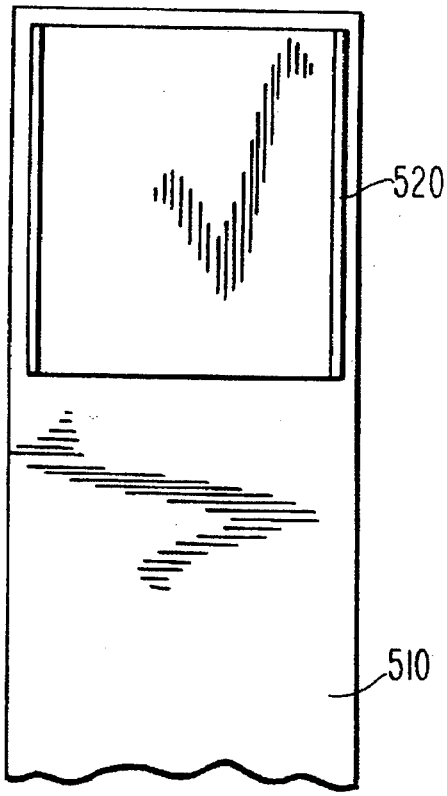
FIG.14
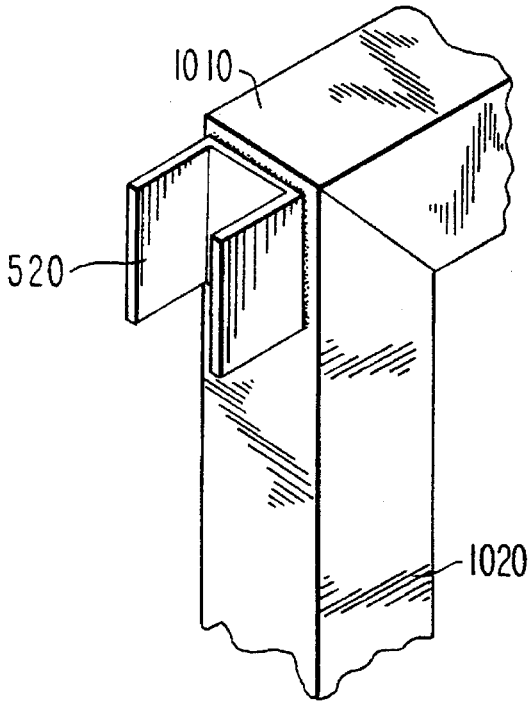

FIG. 27A
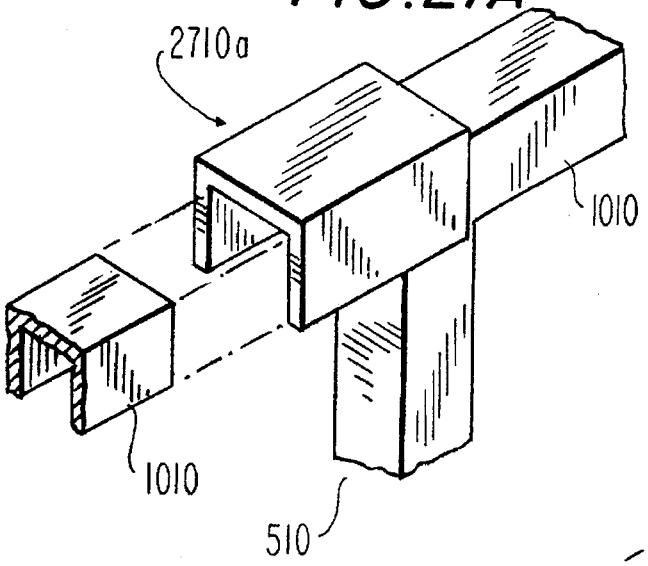
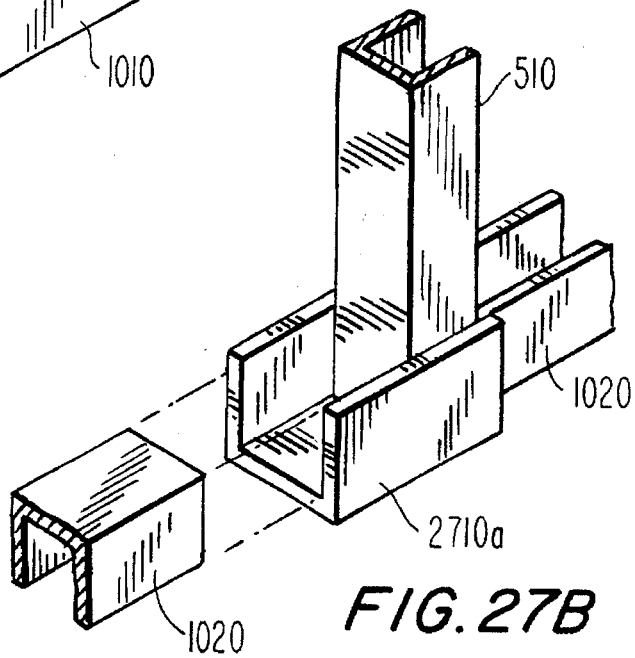
FIG. 27B
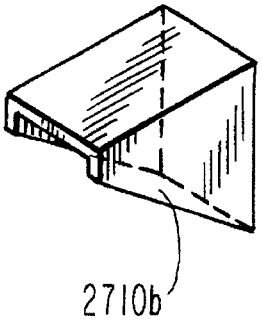
FIG. 27C
FIG. 27D
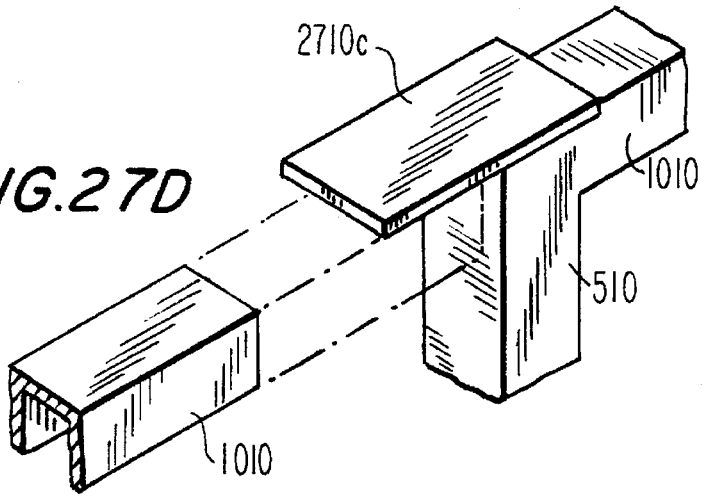

PREFABRICATED BUILDING SYSTEM

CROSS-REFERENCE TO RELATED APPLICATION

This is a continuation-in-part of U.S. patent application Ser. No. 08/132,095, filed Oct. 5, 1993, now U.S. Pat. No. 5,513,473.

BACKGROUND OF THE INVENTION

The present invention relates to a prefabricated building system having lightweight panels which may be directly interconnected. More particularly, the invention relates to panels formed from generally parallel upper and lower studs and at least one vertical stud, forming or leaving a central cavity in the panel. The panels are configured to be directly interconnected along their vertical edges with their axes aligned.

Over the years, the construction industry has attempted to provide simple construction systems which enable the building of stable and aesthetic habitable structures while also allowing the possibility of freedom of design, offering an unlimited choice of selections of exterior and interior finishing, and permitting adaptation of thermal and acoustic insulation (when included) to meet any climate condition or situation. At the same time, such systems must be economically accessible to the public, while using the minimum amount of construction materials and labor and the shortest possible construction time as technically possible.

Prefabricated construction systems have been studied and designed in order to achieve the above described construction system requirements. One type of prefabricated construction system known in the art utilizes basic elements or panels joined together to erect the desired edifice. However, most of these systems do not satisfy all of the above-described specifications.

One such prefabricated construction system having basic elements utilizes sandwich-type panels formed by two solid panels of stranded lumber facings with a solid expanded polystyrene ("EPS") insulation core in between. These panels are generally rectangular and have projections of the lumber facings along one vertical edge and recesses along the other vertical edge. Interconnection of the panels is achieved by fitting the projections of one panel into the recesses of another panel. These panels fit on standard lumber sill plates which are set in place on the floor or foundation of the building.

This type of prefabricated panel has several disadvantages. First, because direct connections between vertical edges cannot be established at wall intersections and at corners, the central alignment planes of the panels (the vertical plane cutting across the center of the panel from the middle of one vertical edge to the middle of the opposite vertical edge) will not meet where the panels intersect. Accordingly, a complete and regular alignment of the central alignment planes of the panels cannot be maintained throughout the structure and the geometric order of the structure cannot be preserved. Nor can the design be easily adapted to atypical building forms, spaces, and arrangements which may be produced with architectural freedom of design. Sometimes other construction methods and materials must therefore be used within the same structure, thus losing uniformity and homogeneity.

Additionally, because the panels are substantially solid, they do not offer an internal air cavity for the free placement of pipes or tubes, or electrical, mechanical, or plumbing installations. Such internal space would be useful during the assembly of the system. Moreover, the solid construction makes such panels rather heavy, requiring more than one person for their handling and installation, thereby increasing construction time and cost.

Finally, the structure of these panels requires specific facing and insulation materials or products. There is no opportunity for creating an internal air cavity needed for such uses as described above. Furthermore, the user does not have the opportunity to select the desired ideal thermal and/or acoustic insulation materials, if required, for the specific construction area or climate condition.

Another common construction system consists of prefabricated concrete elements or panels, having internal welded metal mesh, which receive and transmit loads directly from the ceiling to the foundation base. These panels are rectangular and have a recess in one face formed by an inward mold approximately 1¼ inches deep. Along the vertical edges of the panels, the panels have "_/_" shaped cuts, i.e., V-shaped cuts which do not extend to the corners formed by the panel faces and vertical edges, with the vertex of the cuts facing the panels. When the panels are aligned along their vertical edges, the "_/_" shaped cuts form a substantially closed cavity between the panels. The connection of these panels is effected by inserting a metal plate in this cavity and subsequently pouring cement in the remaining space within the cavity.

This type of prefabricated panel also has several disadvantages. First, these panels limit construction to one story structures because of the specific design of the panels. Also, the task of joining the panels involves the preparation and pouring of cement, the placement of metal plates, etc., and accordingly is rather time consuming and requires constant attention. Because a substantially closed cavity in which cement can be poured is required, a "_/_" shaped cut of one panel must be placed along a face (as opposed to a vertical edge) of the adjoining panel to form a corner, thereby destroying alignment and meeting of the central alignment planes of those panels at the vertical edges. Finally, pipes or tubes, and electrical, mechanical, and plumbing installations are generally located within the molded cavity sides of two panels with their cavities facing one another. This placement doubles the number of panels required, thereby increasing construction costs and the amount of construction space required.

It therefore would be desirable to provide a prefabricated building system which is simple to use, having structural panels which are readily aligned and interconnected, even in atypical structures. The system should allow direct interconnection of panels, so that additional construction elements are not required, thereby reducing construction costs and time. Alignment of the central alignment planes of all of the panels should be maintained throughout the structure.

It would also be desirable to provide a prefabricated building system having lightweight, easily manipulated structural panels, which can be used to construct multi-story buildings.

It would further be desirable to provide a prefabricated building system which is simple to use and allows flexibility of construction materials, including flexibility of thermal and/or acoustic insulation materials used in order to adapt to different climate conditions and other situations. Internal space in which such structural equipment as pipes or tubes, and electrical, mechanical, or plumbing installations may be located should also be provided.

SUMMARY OF THE INVENTION

It therefore is an object of this invention to provide a prefabricated building system having easily interconnected structural panels which allow for direct intersection of the vertical edges and alignment of central alignment planes to provide geometric order throughout the structure. The interconnection should accommodate any atypical or irregular shape required.

It is a further object of this invention to provide a prefabricated building system having lightweight, yet sturdy, structural panels which may be used to construct multi-story buildings. The panels should be easily handled and installed by a single person, without the need for additional construction means.

It is another object of this invention to provide a prefabricated building system allowing total freedom of choice in the selection of the exterior and interior finishings, the thermal and/or acoustic insulation materials (if and when called for), and mechanical, electrical, or plumbing installations as controlled by client taste, climate conditions, client budget, etc.

These and other objects of the invention are accomplished in accordance with the principles of this invention by providing a prefabricated building system having an upper stud, a lower stud, and at least one vertical stud (joining juxtaposed ends of the upper and lower studs), forming a "⊏" shaped frame for the panel. The number of vertical studs (i.e., one or two) depends on the location and function of the particular panel. The vertical studs are designed to directly engage at least one of the studs of another structural panel. The upper and lower studs are generally horizontal and typically have a "⊔" shaped cross-section. Alternatively, the upper and/or the lower stud may have a "⊏⊐" shaped cross section. The vertical studs may either have a "⊔" shaped cross-section or a "V" shaped cross-section. The vertical studs may also have a "⊏⊐" shaped cross section, particularly if the vertical stud is made from metal. The vertical studs may alternatively have a "U" shaped cross section. In addition to the cross sectional shapes illustrated above, the upper stud, the lower stud and the vertical stud may be of any other configuration, provided that studs directly engage each other to form panels of the prefabricated building system of the present invention.

The "⊔" or "⊏⊐" shaped vertical stud may be used along a free edge of a panel to thereby form a finishing or terminal panel. Alternatively, a "⊔" or "⊏⊐" shaped vertical stud may be used for interconnection with another panel. In that case, the "⊔" or "⊏⊐" shaped vertical stud includes at least one "male" connection element necessary to achieve interconnection with another panel. Two male connection elements may be used, one located adjacent the top of the vertical stud and the other located adjacent the bottom of the vertical stud, each slightly narrower than the interior width of the "⊔" or "⊏⊐" shaped upper and lower studs. The male connection elements therefore can form a tight fit inside the upper and lower studs of an adjacent panel to join the two panels. Thus, a continuous and consecutive alignment of panels is effected to construct straight walls of a building.

Corners and intersections of walls are formed by coupling and fixing together the angled faces of vertical studs with "V" shaped cross sections. Such vertical studs could also have a "U" shaped cross section. Thus, the vertical edges of the panels may be directly joined, so that the central alignment planes meet where the vertical edges of the panels meet, thereby maintaining geometric order throughout the structure.

The interconnected panels create a regular structural skeleton that uniformly distributes and transmits all loads and forces. The panels are preferably hollow, and therefore may be handled, transported, and installed easily by a single person.

BRIEF DESCRIPTION OF THE DRAWINGS

The above and other objects and advantages of the invention, its nature, and various advantages will be apparent from the following detailed description of the preferred embodiments, taken in conjunction with the accompanying drawings, in which like reference characters represent like elements throughout, and in which:

FIG. 12 is a rear elevational view along line 12—12 of the panel of FIG. 11;

FIG. 13 is a front elevational view along line 13—13 of the panel of FIG. 11;

FIG. 14 is an enlarged isometric view of a male connection element shown in FIG. 10;

FIG. 15 is an enlarged view of the male connection element shown in FIG. 14, from the plan view perspective of FIG. 11;

FIG. 16 is an enlarged view of the male connection element shown in FIG. 14, from the front elevational view perspective of FIG. 13;

FIGS. 27A–D are fragmentary isometric views of an illustrative interconnection between panels, a connection element being provided upon the upper surface of the upper stud, the lower surface of the lower stud, or upon both such surface.

DETAILED DESCRIPTION OF THE INVENTION

Figure 1:
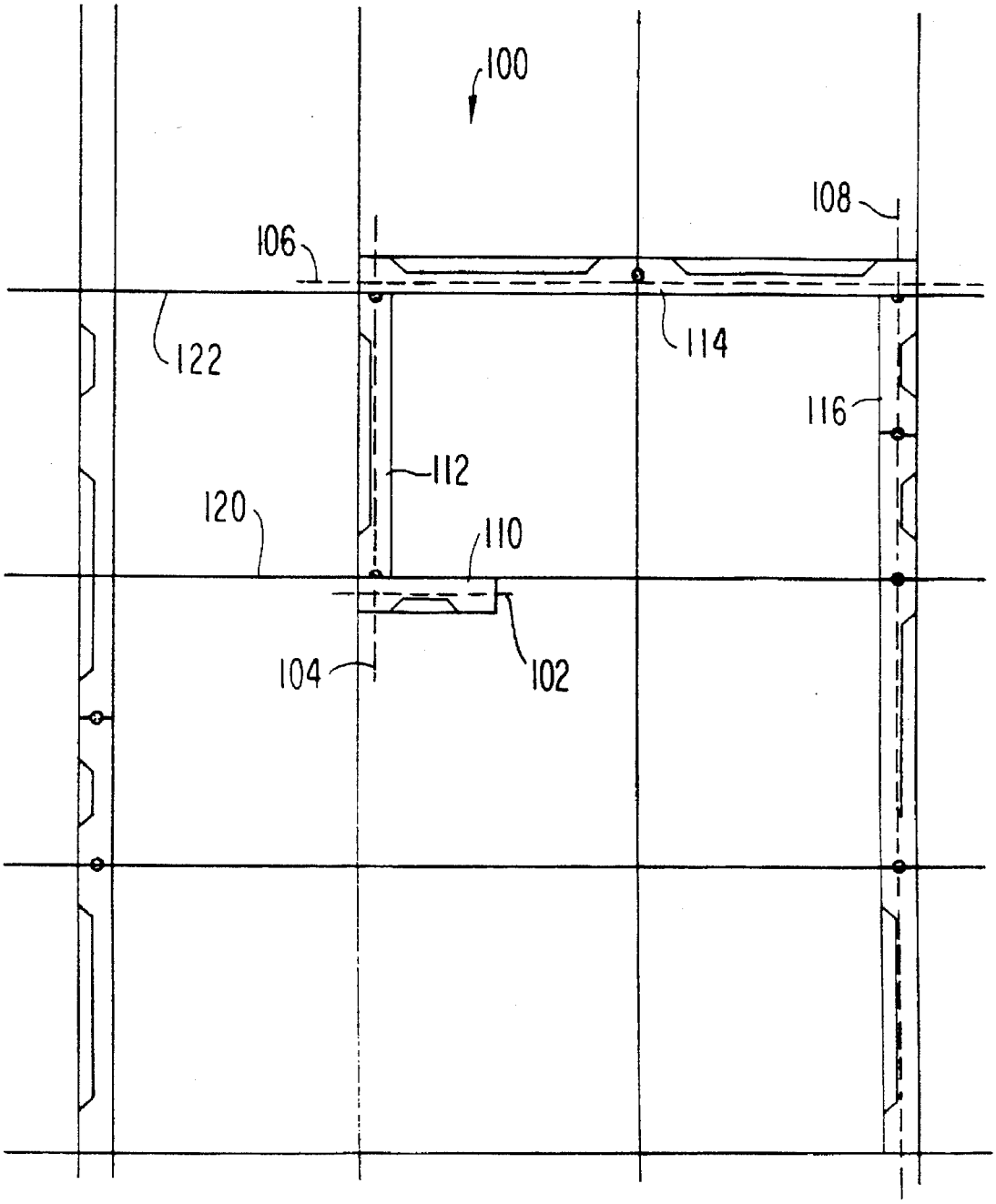
FIG. 1 is a schematic plan view, in cross section, of connections between prior art panels.

A common previously known prefabricated construction system 100 using concrete panels, such as described above, is shown in FIGS. 1–3. As can be seen in FIG. 1, central alignment planes 102, 104, 106, and 108 do not always meet where panels 110, 112, 114, and 116 meet. Instead, the ends of panel 112 along central alignment plane 104 are displaced to the right of the ends of panels 110 and 114 so that central alignment planes 102, 104, and 106 intersect beyond the point of intersection of the vertical edges of panels 110, 112, and 114. Similarly, the free ends of panels 114 and 116 do not meet along their respective central alignment planes 106 and 108. Planes 102, 104, 106, and 108 accordingly are not considered to be properly aligned in the arrangement of construction system 100 shown in FIG. 1. As a result, the geometric order of the structure is not maintained, as can be seen upon comparison of the location of panel 110 below grid line 120 and panel 114 above grid line 122 (geometric order within the structure would require both panels to be on the same side of their respective grid line, i.e., either both above or both below).

Figure 2:
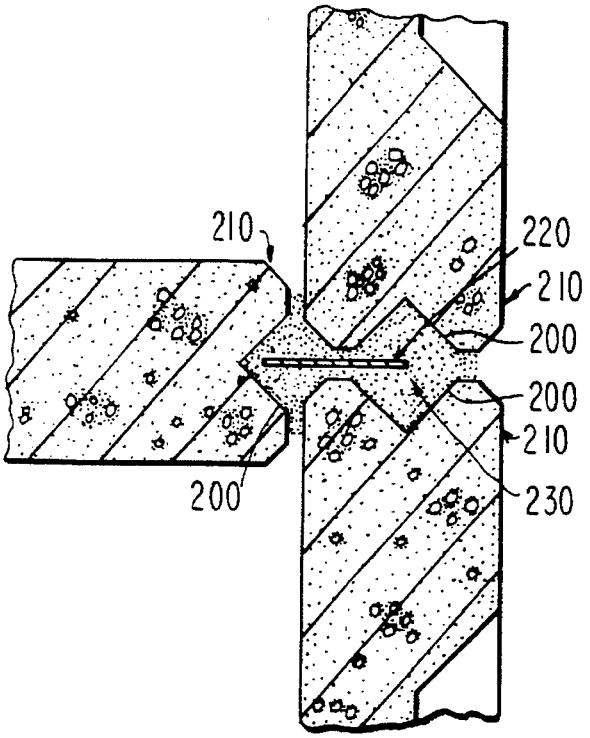
FIG. 2 is a cross-sectional view of a three panel "⊢" shaped intersection formed with panels of the prior art.
Figure 3:
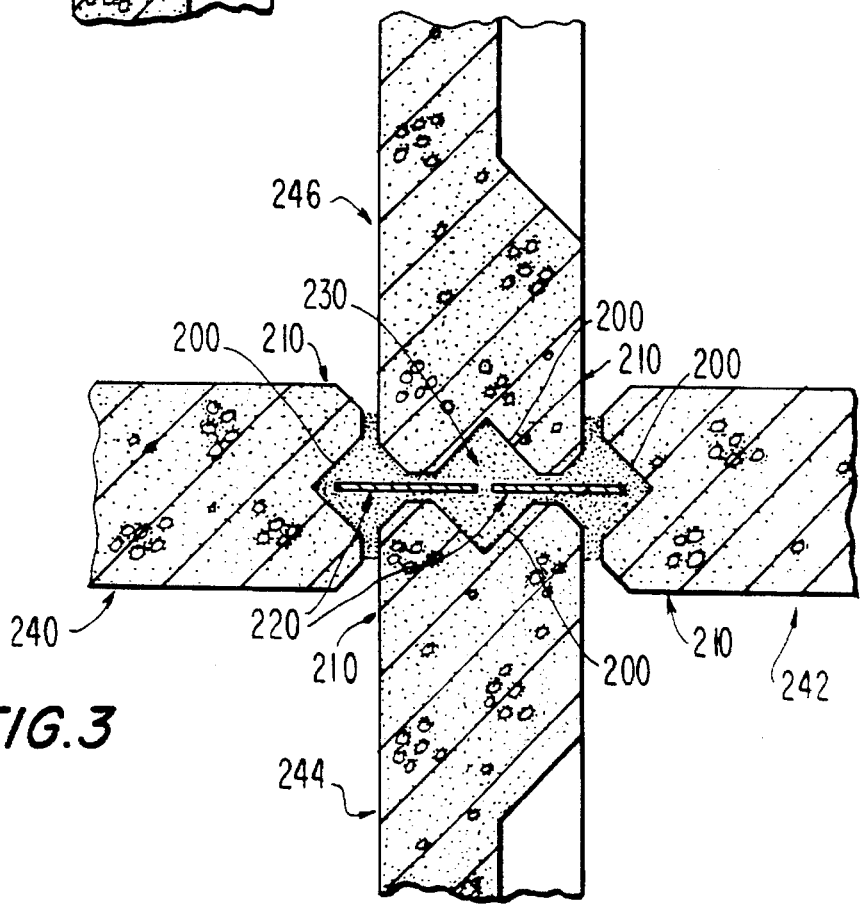
FIG. 3 is a cross-sectional view of a four panel "+" shaped intersection formed with panels of the prior art.

As shown in FIGS. 2 and 3, the vertical edges of the panels of system 100 have "_/_" shaped cut out portions 200. The concrete panels of system 100 are joined by placing together the "_/_" shaped cut out portions 200 of the panels to be joined, inserting expanded metal plates 220 (or dowels, or the like) in the spaces formed by cut out portions 200, and pouring cement or mortar 230 into the spaces. For the "⊢" shaped intersection of three panels shown in FIG. 2, only one metal plate 220 is necessary. However, for the "+" shaped intersection of four panels shown in FIG. 3, typically at least two metal plates 220 are necessary to bridge the distance between aligned panels 240, 242 positioned on either side of aligned panels 244, 246. The method required to join the panels in FIGS. 1–3 clearly is time consuming, requiring prior preparation of the connecting materials, and precise insertion of the materials.

Figure 4:
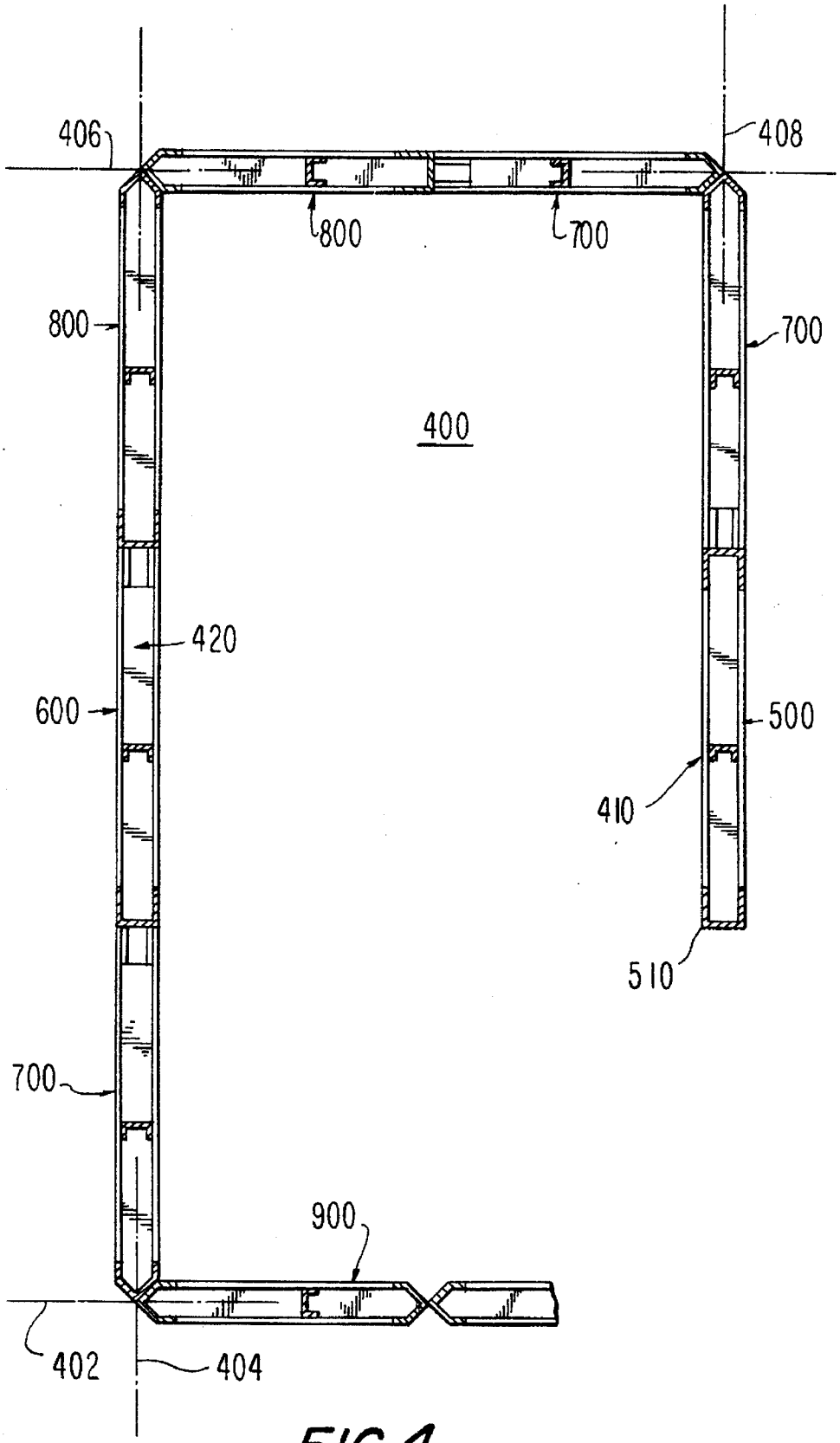
FIG. 4 is a schematic plan view, in cross-section, of an illustrative configuration formed with the structural panels of the present invention.
Figure 5:
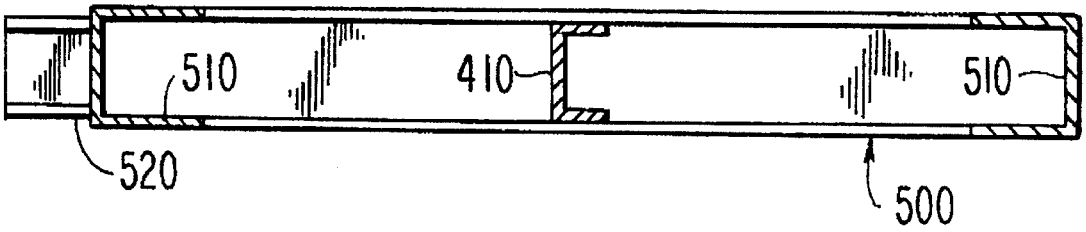
FIG. 5 is a transverse cross-sectional view of an end panel having a connecting stud along one vertical edge.

Construction system 400 of the present invention is shown in FIGS. 4–28. As can be easily seen, unlike the panels of system 100, the ends of panels 500, 600, 700, 800, and 900 are aligned and meet along their central alignment planes 402, 404, 406, and 408. Furthermore, panels 500, 600, 700, 800, and 900 (shown individually in FIGS. 5–9, respectively) are easily interconnected by direct attachment along their vertical edges with either male connection elements 520 (shown in more detail in FIGS. 5, 6 and 10–16) or "⋁" or "▽" shaped studs 710 (shown in more detail in FIGS. 7–9, 17–20, and 28B). Typically, the panels are welded, screwed, or otherwise directly fastened to one another, thereby reducing costs and construction time. The continuous alignment of the panels, throughout the different floor levels, and the successive interconnection of the panels, will create a uniform structural skeleton as shown in FIGS. 4 and 21.

Construction system 400 can be used to erect exterior or interior walls, for any habitable structure, using any of five basic types of panels 500, 600, 700, 800, and 900. The structural design of each panel is defined by three or four elements or studs about the perimeter of the panel (see FIG. 21), adjacent studs joined at an angle A of preferably 90°. The panels are preferably formed from galvanized metal, stainless steel, solid wood, solid reinforced PVC, solid special plastics, waste-plastic composites, cellular fiber plastics, extruded structural components and derivatives, or any other solid materials, solid reinforced materials or hollow materials with the structural capacity and strength required for the construction of a habitable structure. The studs are shaped to create the specific desired cross-section, whether hollow or solid. When necessary, one or more stiffener elements 410 (depending on the length of the panel) of any desired configuration may be used. Each stiffener element 410 is preferably aligned vertically within the panel between the upper and lower studs, and preferably generally perpendicular to at least the lower stud.

Figure 10:
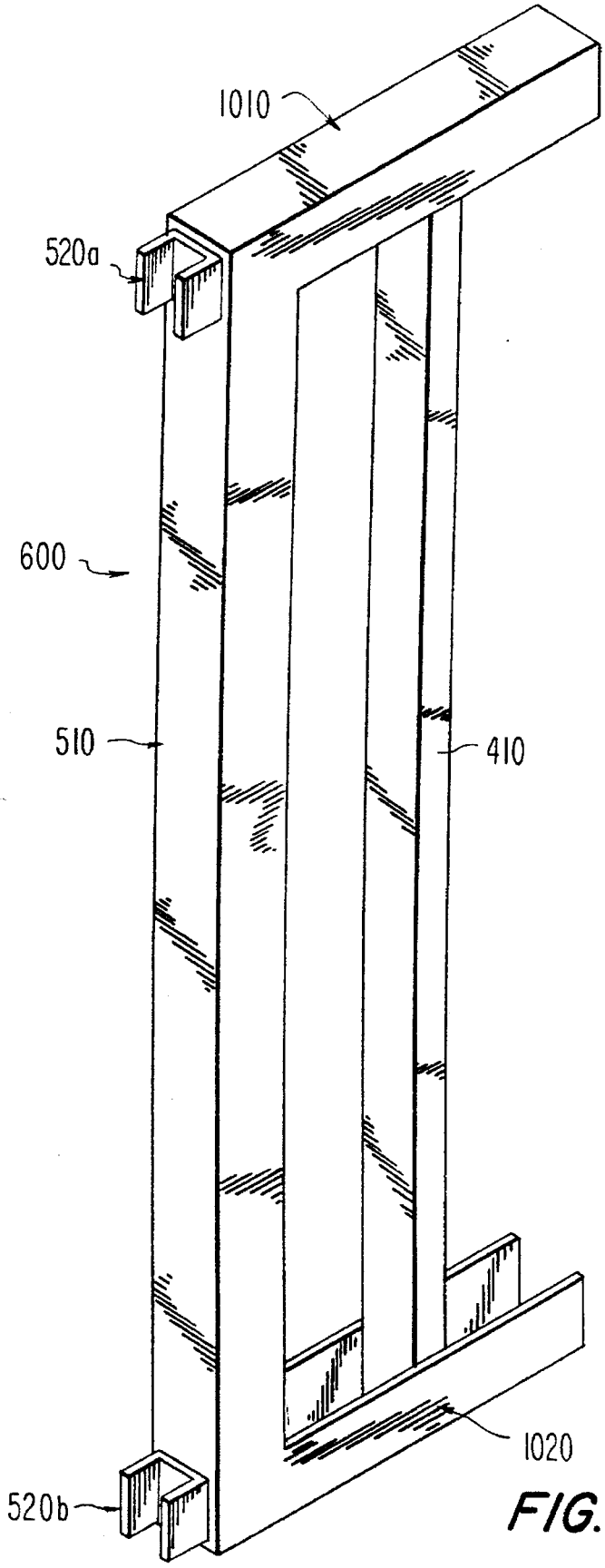
FIG. 10 is an isometric view of the panel of FIG. 6.
Figure 21:
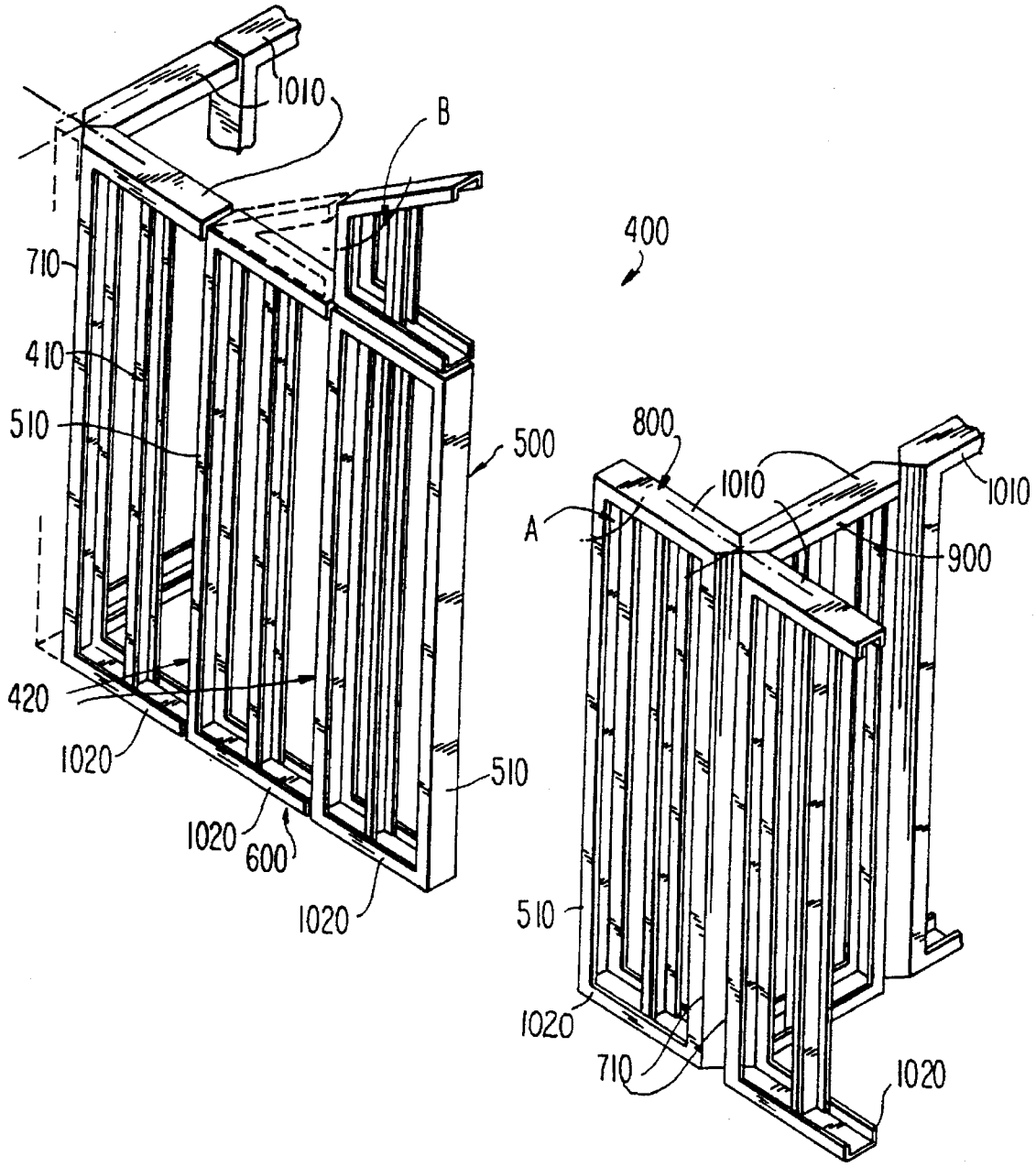
FIG. 21 is an isometric view of interconnected panels of the present invention forming a regular structural building skeleton in accordance with the principles of this invention.

All of the five panels 500, 600, 700, 800, and 900 have in common with one another at least two sides—upper stud 1010 and lower stud 1020, shown in FIGS. 10 and 21. Upper stud 1010 and lower stud 1020 are preferably "⊔" shaped, having two parallel sides joined, perpendicularly, along juxtaposed free ends with a third side, and are generally horizontally positioned, parallel to each other. Upper stud 1010 and/or lower stud 1020 could alternatively have a "⊏⊐" shaped cross section, which additionally has two end segments **2810*a* perpendicularly joined to the other juxtaposed free ends of the two parallel sides and parallel to the perpendicular third side. It should also be understood that many design variations in the shape of the cross sections of upper and lower studs 1010, 1020 are within the scope of the present invention. The cross sections specifically shown are presented for the purpose of illustration and not of limitation. At least one vertical stud 510 or 710 (see FIG. 21) connects upper and lower studs 1010 and 1020. As seen, for example, in FIGS. 8 and 21, vertical stud 510 has a generally "⊔" shaped cross-section (similar to upper and lower studs 1010 and 1020), whereas vertical stud 710 has a generally "⋁" or "▽" shaped cross-section, having two parallel sides joined along their juxtaposed free ends by two converging sides forming a vertex directed away from the parallel sides, the "▽" shaped cross section (shown in more detail in FIG. 28B) further having two end segments 2810*b* perpendicularly joined to the other juxtaposed free ends of the two parallel sides. Vertical stud 510 may alternatively have a "⊔" shaped cross section, particularly if it is made of metal. It should also be understood that many design variations in the shape of the cross sections of vertical studs 510 and 710** are within the scope of the present invention. The cross sections specifically shown are presented for the purpose of illustration and not of limitation. The choice of which and how many vertical studs are to be used in the formation of a panel depends on the function and ultimate location of the panel within the system, as will be described in greater detail below.

Figure 22:
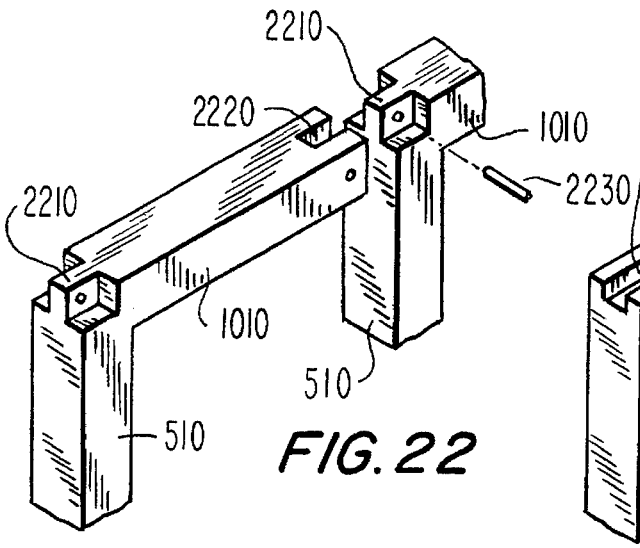
FIG. 22 is a fragmentary isometric view of an illustrative connection between panels, one panel having a male connection element positioned along the intersection of its vertical and horizontal studs and the other panel having a female connection element position along an upper stud.
Figure 23:
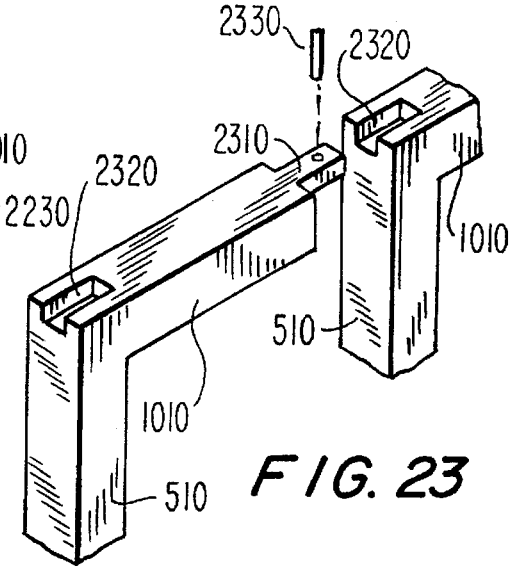
FIG. 23 is an fragmentary isometric view of an illustrative interconnection between panels, one panel having a male connection element positioned along an upper stud and the other panel having a female connection element positioned along the intersection of its vertical and horizontal studs.
Figure 24:
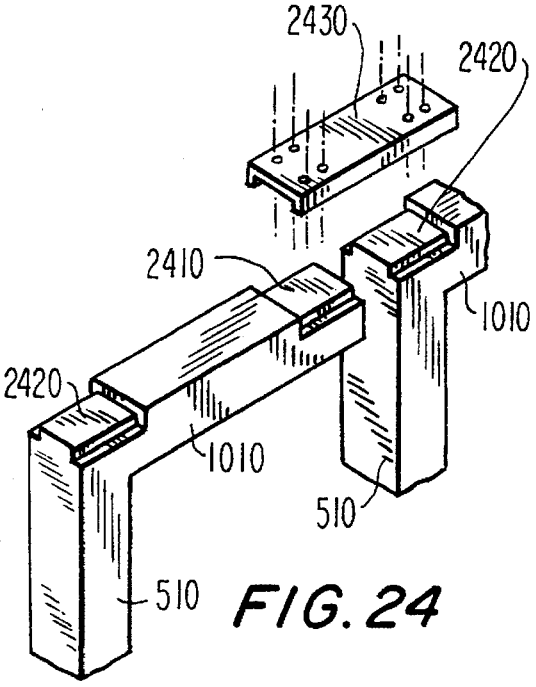
FIGS. 24 nd 25 are fragmentary isometric views of panel connections accomplished through the use of a third-piece connection element.
Figure 25:
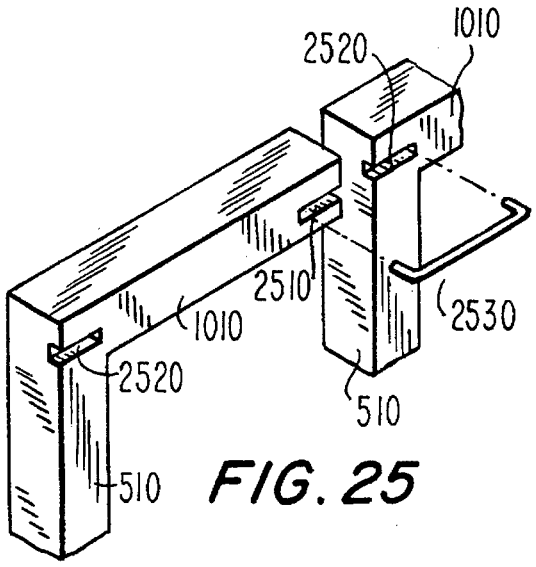

The shape of the vertical stud determines its function. Vertical studs 510, having a "⊔" or "⊔" shaped cross-section with a flat vertical base, are typically used at the end of a panel to finish the vertical edge of a panel, as shown in FIGS. 4, 5, 8, and 21. Panels with a "⊔" or "⊔" shaped vertical stud 510 allow for a unidirectional interconnection, i.e, such panels can only be interconnected with one other panel along the opposite vertical edge. However, with the addition of a male connection element 520 on the flat based of "⊔" or "⊔" shaped vertical studs 510, as shown in FIGS. 5, 6, and 10–16, or such male and female interconnections as shown in FIGS. 22, 23 and 27, or third-piece connection elements as shown in FIGS. 24 and 25, panels with "⊔" or "⊔" shaped vertical studs 510 may be interconnected along those studs to form a substantially straight wall configuration. Panels having "V" or "V" shaped vertical studs 710, such as shown in FIGS. 7–9 and 17 are typically used for perpendicular intersections or corners, as shown in FIGS. 18–21.

Figure 26A:
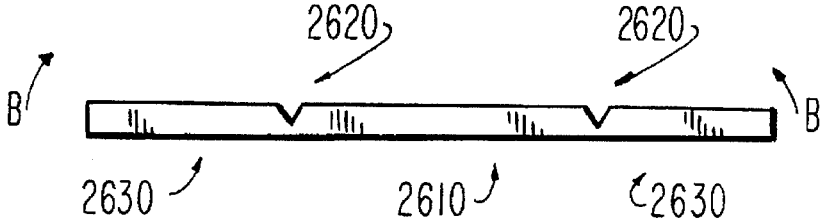
FIGS. 26A–C are side views and FIG. 26D is a fragmentary isometric view illustrative of two methods of assembling a panel of the present invention.
Figure 26B:
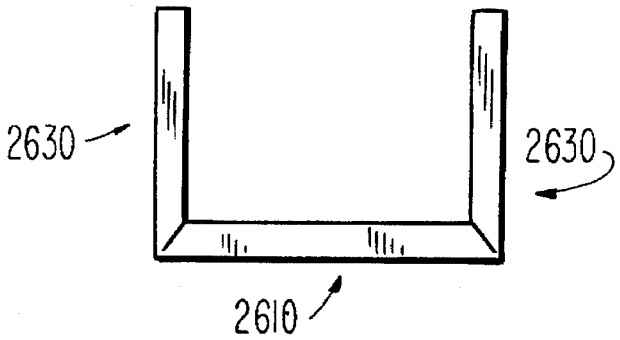
Figure 26C:
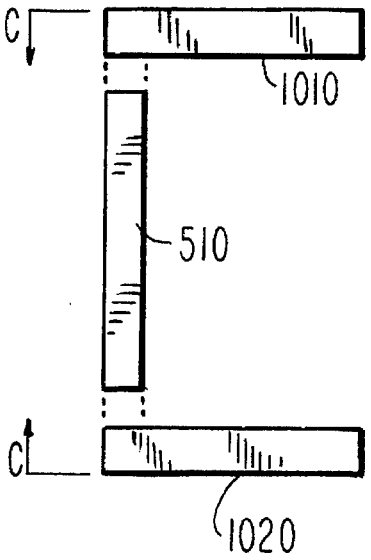
Figure 26D:
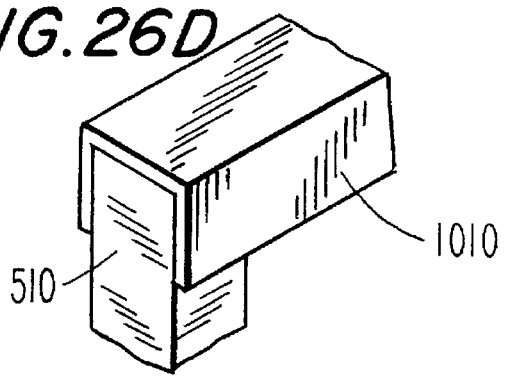
Figure 28A:
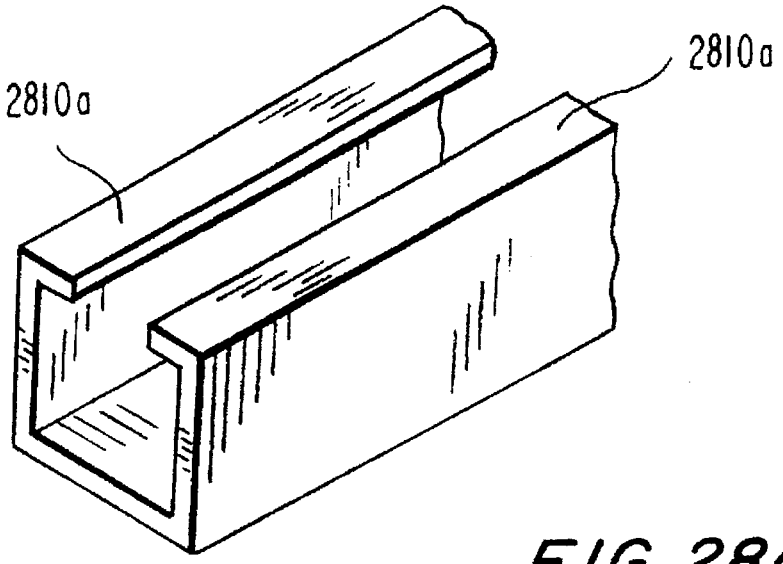
FIGS. 28A–B are fragmentary isometric views of "⊏⊐" and "▽" shaped studs, respectively, each having two end segments perpendicularly joined to the juxtaposed free ends of the two vertical parallel sides.
Figure 28B:
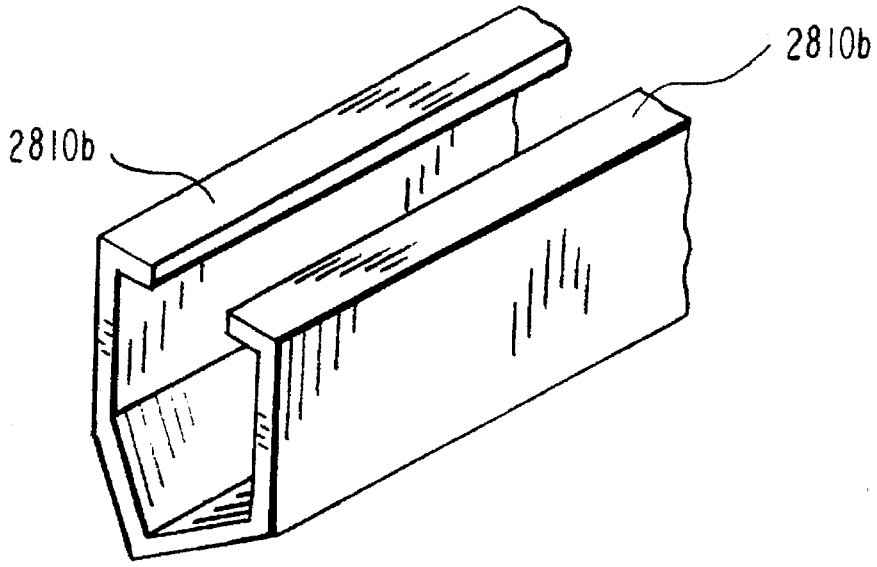

The panels 500, 600, 700, 800, and 900 may be assembled from a one-piece element stud 2610, shown in FIGS. 26A and 26B. Panels 500, 600, 700, 800, and 900 may also be assembled using a vertical stud 510 or 710 and then fitting the vertical stud 510 or 710 separately between upper and lower studs 1010, 1020, as shown in FIGS. 26C and 26D, and for example in FIG. 10. In the embodiment shown in FIGS. 26A and B, one-piece element stud 2610 is provided with two 90° angle cuts 2620 positioned at 45° angles and located at definite distances from the free ends of one-piece element stud 2610. The extreme sections 2630 of one-piece element stud 2610 are bent in the direction of the arrows B shown in FIG. 26A to form the "⊏" shaped panel shown in FIG. 26B.

In the embodiment shown in FIGS. 26C and 26D, upper stud 1010 and lower stud 1020 are fitted into vertical stud 510 or 710 in the directions of the arrows C, shown in FIG. 26C. Thus, the type of intersection shown in FIG. 26D is formed. It should be appreciated that such an arrangement for interconnecting upper studs 1010, lower studs 1020 and vertical studs 510 or 710 is appropriate no matter what the configuration of the cross sections of upper studs 1010, lower studs 1020 and vertical studs 510 or 710.

Figure 11:
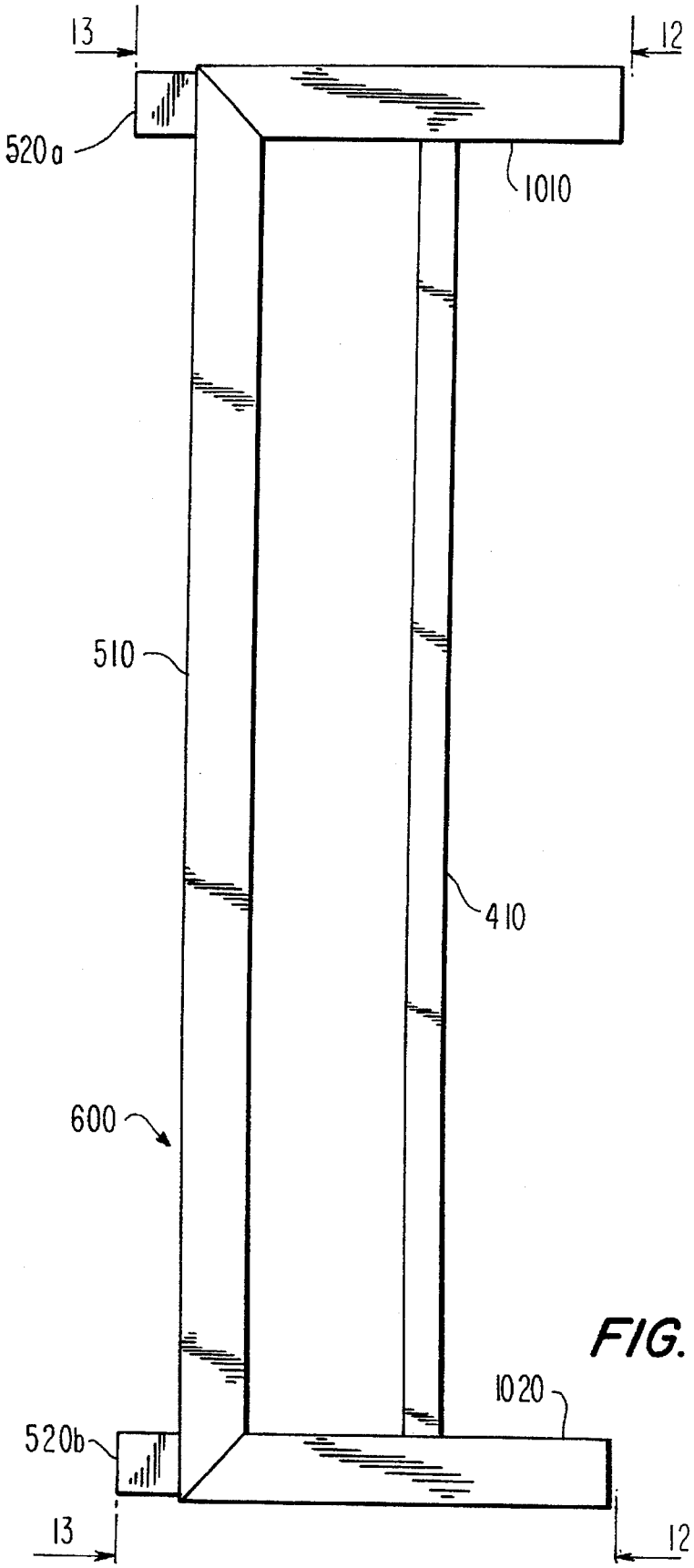
FIG. 11 is a plan view of the panel of FIG. 6.
Figure 17:
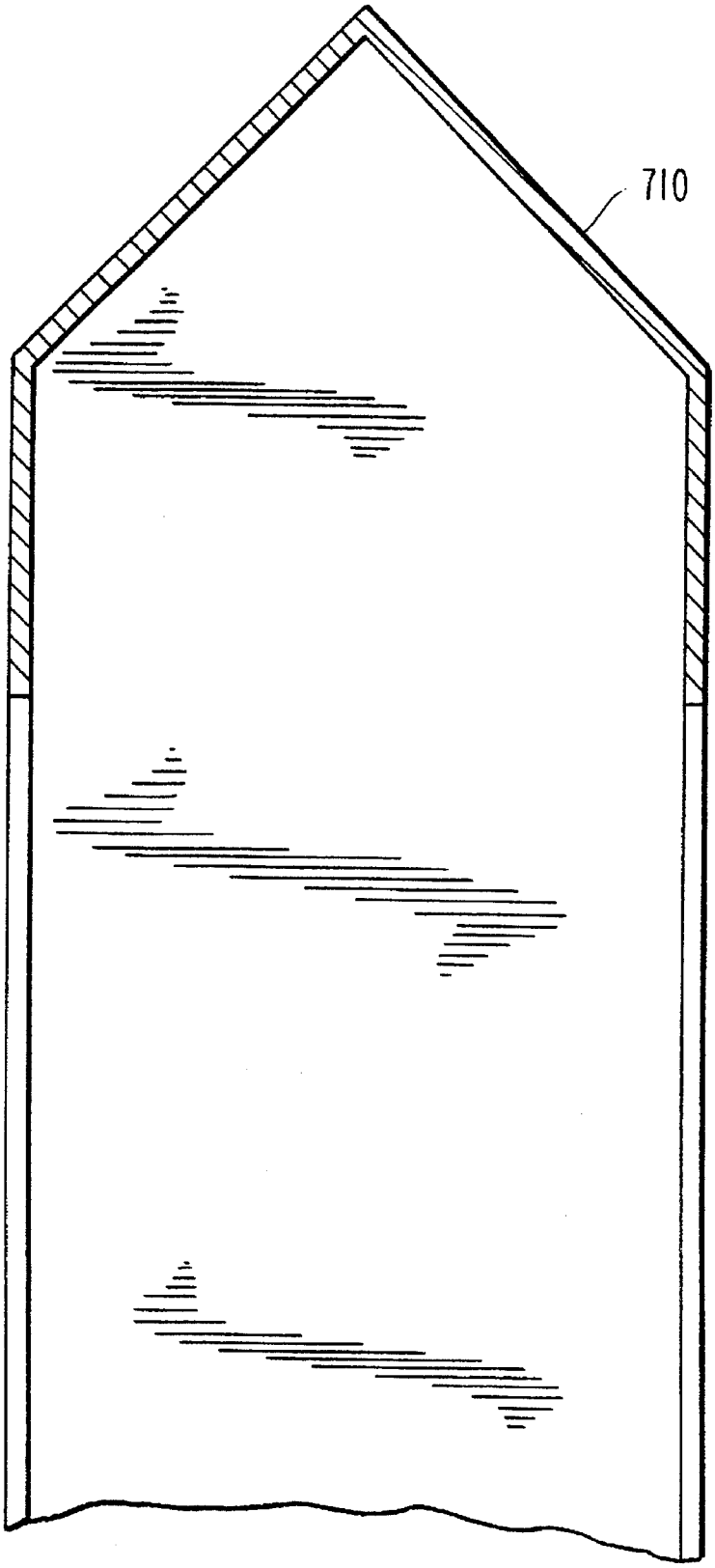
FIG. 17 is a cross-sectional view of the "V" shaped stud shown in the panels of FIGS. 7–9 and used in a generally perpendicular intersection of panels.
Figure 18:
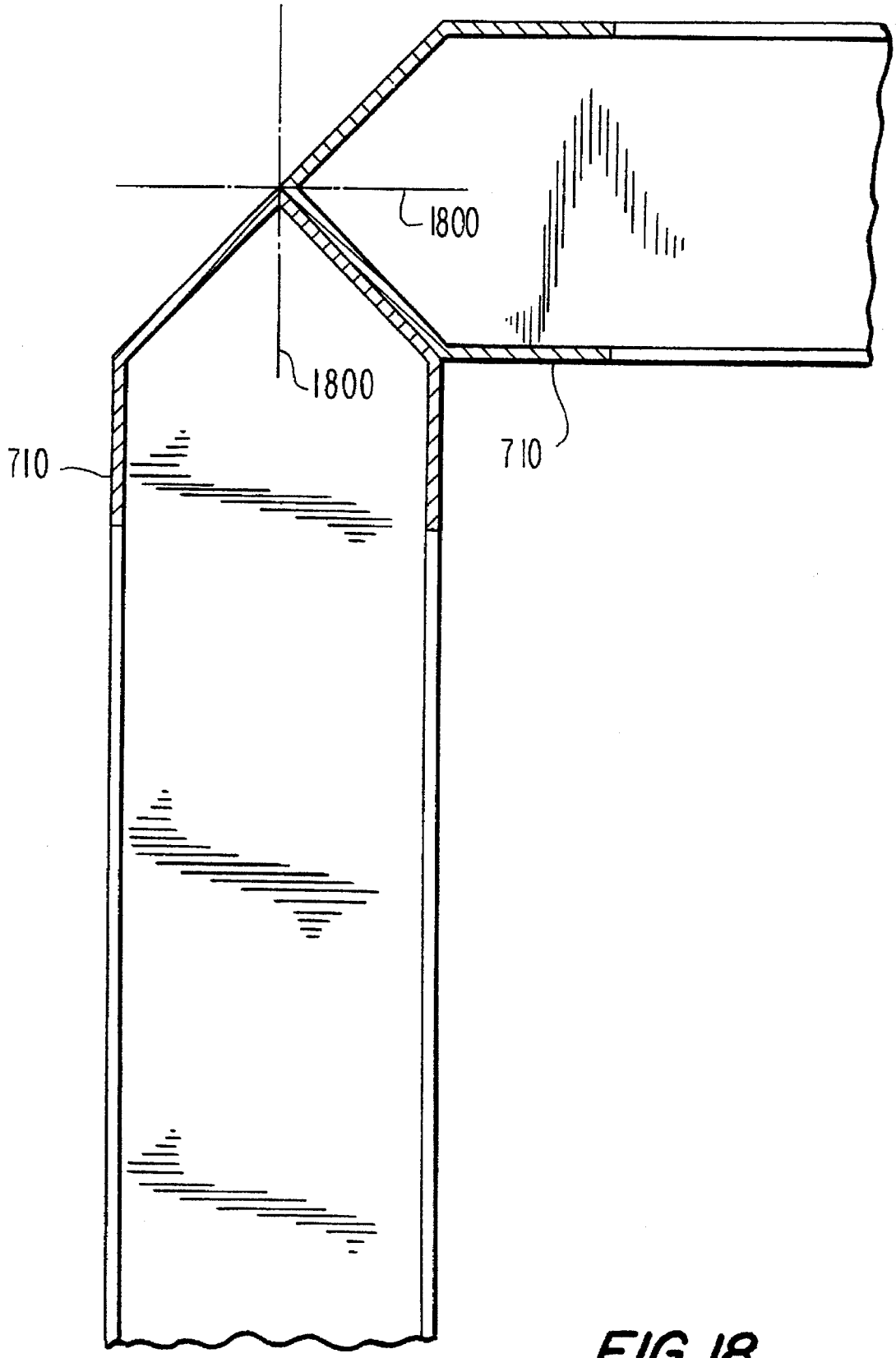
FIG. 18 is a cross-sectional view of two panels with "V" shaped studs forming an "⌐" shaped connection, e.g., a corner of a building.
Figure 19:
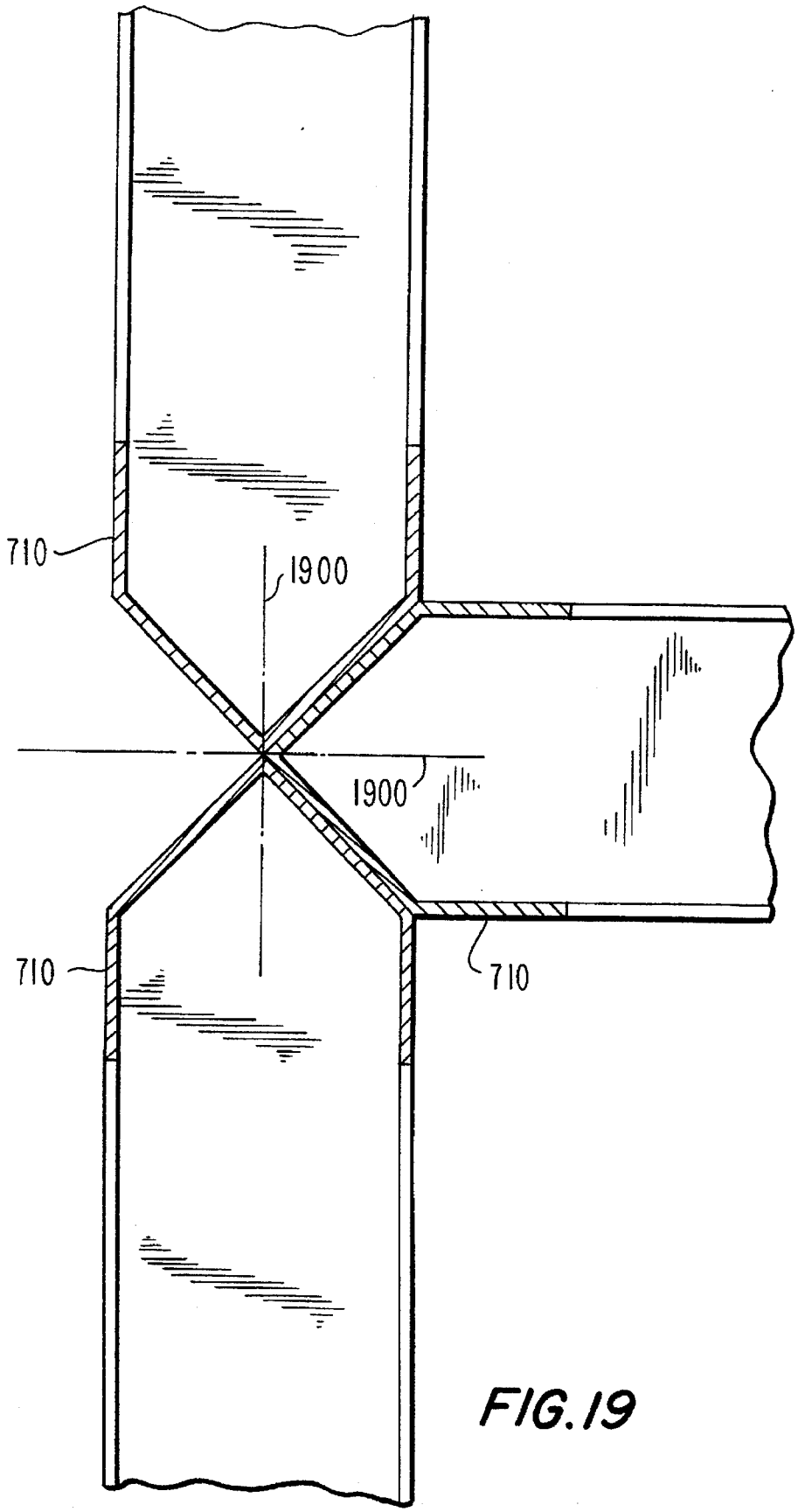
FIG. 19 is a cross-sectional view of three panels with "V" shaped studs forming a "⊢" shaped connection, e.g a panel perpendicularly connected in the middle of a straight wall configuration.
Figure 20:
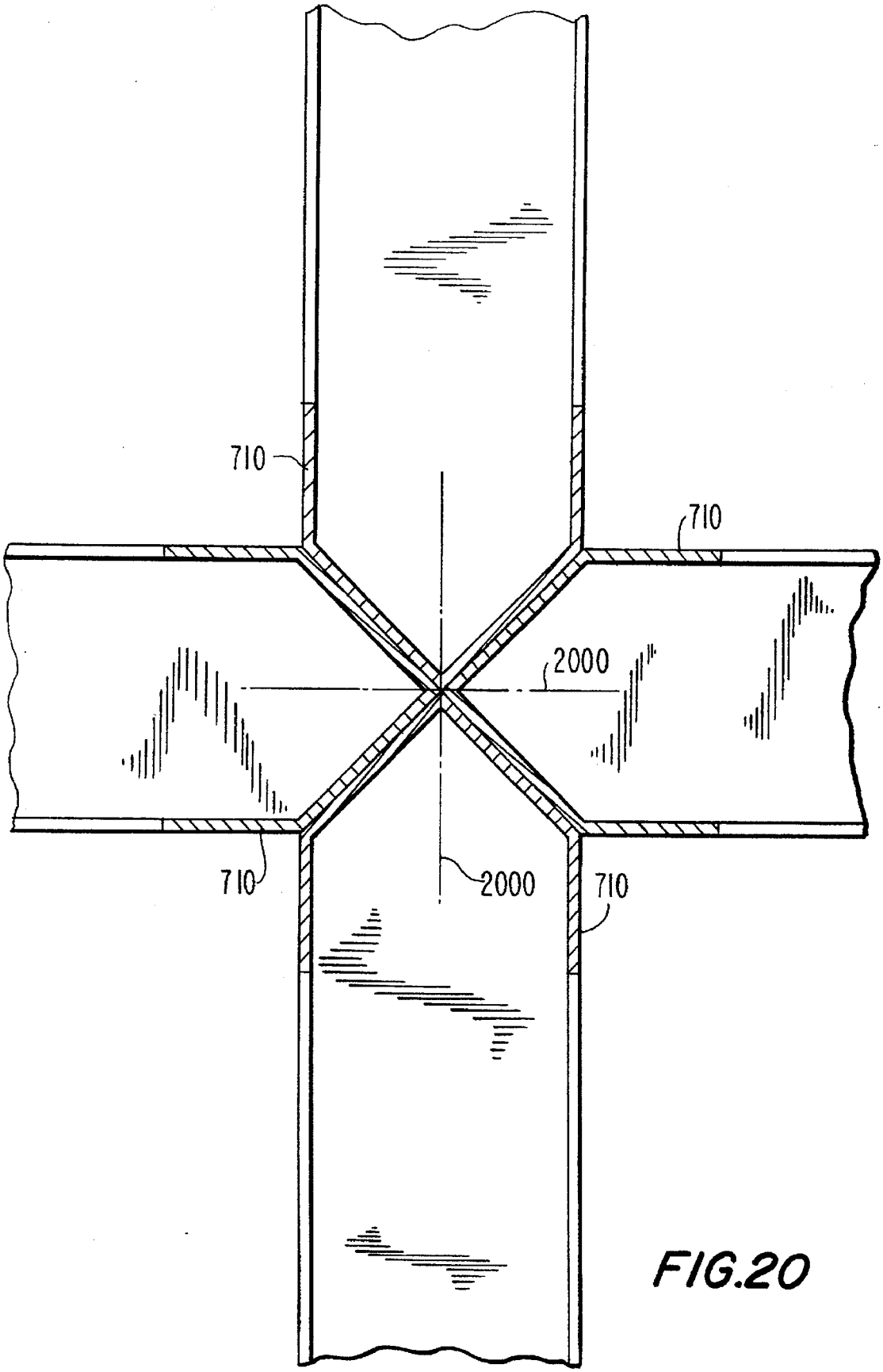
FIG. 20 is a cross-sectional view of a four panel "+" shaped intersection, i.e., the intersection of two straight wall configurations.

Preferably two male connection elements 520*a* and 520*b* are used on "⊔" or "⊔" shaped vertical stud 510. A preferred design for male connection elements 520*a* and 520*b* is shown in FIGS. 10, 11, and 13 and in enlarged isolation in FIGS. 14–16. As most easily seen in FIGS. 10 and 14, male connection elements 520*a* and 520*b* preferably has a "⊔" shaped cross-section, similar to that of upper and lower studs 1010 and 1020. However, the distance between the parallel sides of male connection element 520 is preferably smaller than the distance between the parallel sides of upper and lower studs 1010 and 1020 so that male connection element 520 can fit into studs 1010 and 1020. The respective distances may be compared upon viewing FIGS. 12 and 13.

It will be understood that male connection element 520 can have any other desired configuration which preferably will fit into an adjoining panel to allow for proper interconnection. For example, connection elements can be configured and positioned to join adjacent panels along the intersection of the vertical and horizontal studs of one of the panels. As shown in FIG. 22, a male connection element 2210 is formed along the intersection of the vertical and horizontal studs of a panel. A female connection 2220 is provided at least along upper stud 1010 of the adjacent panel to accept male connection element 2210 and thereby form a secure connection between the panels. Pin (or screw or any other securing element) 2230 may be used to further secure the connection.

Alternatively, as shown in FIG. 23, a male connection element 2310 may be provided on the free end of upper stud 1010. The matching female connection 2320 would then be provided at the intersection of the vertical and horizontal studs of the adjacent panel to accept male connection element 2310 and thereby form a secure connection between the panels. Pin (or screw or any other securing element) 2330 may be used to further secure the connection.

Male connection elements such as elements 2210 and 2310 may be any desired shape, and may be generally angular and uniformly dimensioned (as shown in FIGS. 22 and 23), or may have an expanded, widened distal end. The associated female connection should substantially match the configuration of the male connection element.

In embodiments previously described, male connection element 520 is fixed to the side of vertical stud 510 or 710 that is perpendicular to upper horizontal stud 1010 and lower horizontal stud 1020 (i.e., the vertical edge of panel 500, 600, 700, 800 or 900). The side of vertical stud 510 or 710 to which male connection element 520 is fixed adjoins another vertical stud 510. For example, such an embodiment is shown in FIGS. 10 and 14. The male connection element 520 may have any shape or design, provided that it fits tightly between parallel sides of horizontal studs 1010, 1020, or both studs 1010 and 1020.

Alternatively, as shown in FIGS. 27A–D, the connection element 2710 may be fixed to the top of upper horizontal stud 1010 (shown in FIG. 27A), or to the bottom of lower horizontal stud 1020 (shown in FIG. 27B). Also, a connection element 2710 may be fixed to both the top of upper horizontal stud 1010 and to the bottom of lower horizontal stud 1020. The connection element 2710 may have any desired shape, for example either of the shapes 2710*a*, 2710*b* shown in FIGS. 27A–C, in order to secure the connection. If the connection element 2710*a,b* is fixed to the top of upper horizontal stud 1010, as shown in FIG. 27A, then the adjoining upper horizontal stud 1010 fits tightly between the parallel sides of the connection element 2710*a, b*, as indicated by the dashed lines in FIG. 27A. If the connection element 2710*a,b* is fixed to the bottom of lower horizontal stud 1020, as shown in FIG. 27B, then the adjoining lower horizontal stud 1020 fits tightly between the parallel sides of the connection element 2710*a,b* as indicated by the dashed lines in FIG. 27B. If two connection elements 2710 are used, one fixed to the upper surface of upper horizontal stud 1010 and the other fixed to the lower surface of lower horizontal stud 1020, then the adjoining upper horizontal stud 1010 fits tightly into upper connection element 2170, and the adjoining lower horizontal stud 1020 fits tightly into lower connection element 2710.

The connection element 2710*c* may alternatively be a plate fixed on top of the upper horizontal stud, as shown in FIG. 27D. The upper horizontal stud 1010 of the adjoining panel fits under plate 2710*c* and may be secured to it by any means, as indicated by the dashed lines. The connection element 2710*c* may also be fixed to the bottom of lower horizontal stud 1020, or a connection element 2710*c* may be fixed to both the upper horizontal stud 1010 and to the lower horizontal stud 1020.

Connection of panels can also be accomplished through the use of a third-piece connection element as illustrated in FIGS. 24 and 25. In FIG. 24, horizontal stud 1010 has receiving area 2410 and the intersection of studs 1010 and 510 has receiving area 2420. Receiving areas 2410 and 2420 receive third-piece connection element 2430, which may be further secured in receiving areas 2410 and 2420 with bolts, screws, adhesive, or any other desired securing means. Although a plate-like third-piece connection element 2430 is shown in FIG. 24, any other configuration, such as staple-like connection element 2530, (as shown in FIG. 25) may be used. Any desired number of staple-like third-piece connection elements may used in the embodiment of FIG. 24, in parallel arrangements or crossing over one another to form "X" configurations. The receiving areas can alternatively be formed along the sides of the studs, such as in FIG. 25. In FIG. 25, staple-like third-piece connection element 2530 fits into receiving area 2510 in horizontal stud 1010 and receiving area 2520 in the intersection of studs 1010 and 510. The receiving areas in FIGS. 24 and 25 may have any desired configuration to match the configuration of the third-piece connection element used.

The male and female connection elements 2210 and 2220, and 2310 and 2320, (shown in FIGS. 22 and 23, respectively), or the third-piece connection elements 2430 and 2530 (shown in FIGS. 24 and 25, respectively) can be provided at least once using the upper panel intersection of the vertical stud with the upper horizontal stud and the upper horizontal stud of the adjacent panel. The male and female connection elements 2210 and 2220, and 2310 and 2320, or the third-piece connection elements 2430 and 2530 can alternatively be provided at least once using the lower panel intersection of the vertical stud with the lower horizontal stud and the lower horizontal stud of the adjacent panel. Alternatively, the male and female connection elements 2210 and 2220, and 2310 and 2320, or the third-piece connection elements 2430 and 2530 can be provided both at the upper panel intersection of the vertical stud with the upper horizontal stud and the upper horizontal stud of the adjacent panel and at the lower panel intersection of the vertical stud with the lower horizontal stud and the lower horizontal stud of the adjacent panel.

When upper stud 1010 and lower stud 1020 of a panel are joined at first juxtaposed ends with a stud 510, and at second juxtaposed ends with a stud 510 having male connection elements 520, the result is panel 500, shown in FIGS. 4, 5, and 10–13. If male connection elements 520 or the male/female connections Of FIGS. 22, 23 and 27 are used on only one of the vertical studs 510, then panel 500 may be used as a finishing or terminal panel, as shown in FIG. 4. However, if both "⊔" or "[ ]" shaped vertical studs 510 have male connection elements 520 or the connections formed at the intersection of horizontal and vertical studs shown in FIGS. 22, 23 and 27, then panel 500 can be joined between panels to form a substantially straight wall configuration.

Figure 6:
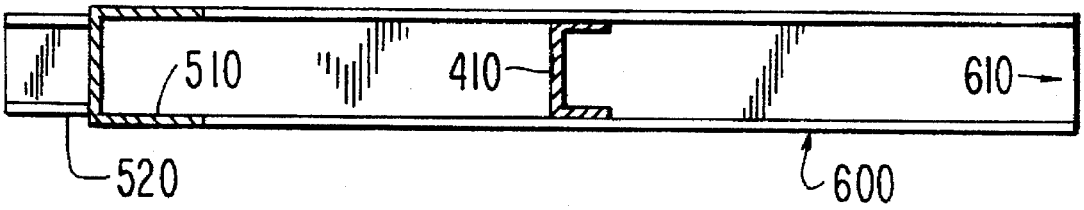
FIG. 6 is a transverse cross-sectional view of a panel which may be used between two other panels in a straight wall configuration.

If only one vertical stud 510 with male connection elements 520 or the male/female connections of FIGS. 22, 23 and 27 are used, and the other vertical edge does not have a stud, then panel 600 of FIGS. 4 and 6 is formed. Panel 600 is capable of bidirectional interconnections and can be joined between two panels to form a substantially straight wall configuration.

Figure 7:
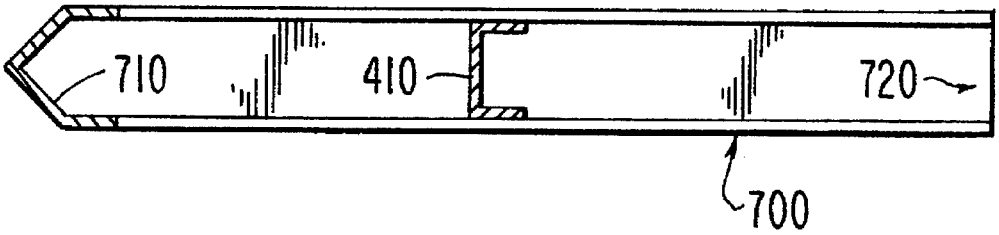
FIG. 7 is a transverse cross-sectional view of a panel which may be joined perpendicularly along a first vertical edge to a panel and joined in a straight wall configuration along the second vertical edge.
Figure 8:
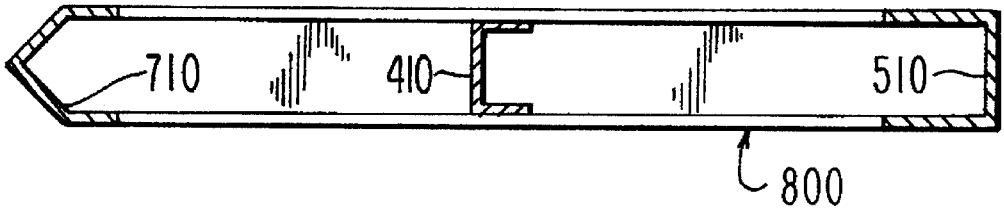
FIG. 8 is a transverse cross-sectional view of an end panel which may be joined perpendicularly along one vertical edge.
Figure 9:
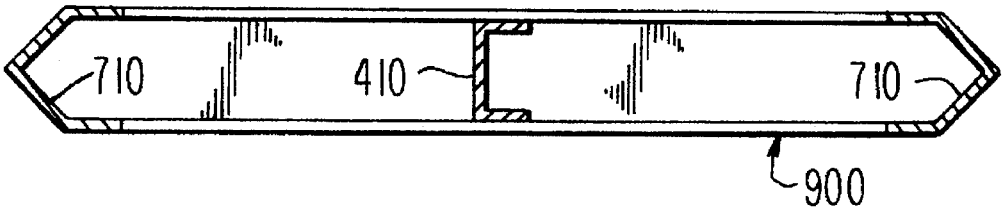
FIG. 9 is a transverse cross-sectional view of a panel which is configured to be joined perpendicularly along both vertical edges to another panel.

Panels 700, 800, and 900 of FIGS. 7, 8, and 9, respectively, include at least one "⋁" or "▽" shaped vertical stud 710. Panel 700 is similar to panel 600 in that only one vertical stud is used. The other vertical edge does not have a stud and receives male connection members 520, or is configured to form connections such as those shown in FIGS. 22, 23 and 27, to form a straight wall configuration along that vertical side. The side with "⋁" or "▽" shaped vertical stud 710 typically is used to form a perpendicular connection with a similar "⋁" or "▽" shaped vertical stud 710, as shown in FIGS. 4 and 18–21.

Panel 800 is similar to panel 500 in that a "⊔" or "[ ]" shaped vertical stud 510 is used on one side such that panel 800 may be used as a finishing panel. However, if desired, connection elements having a configuration similar to those shown in FIGS. 10–13 or 22, 23 and 27 may be included along stud 510, as shown in FIG. 4. That vertical edge may then be joined to the vertical edge of another panel to form a straight wall configuration at that end of panel 800. The vertical edge having "⋁" or "▽" shaped stud 710 typically is interconnected perpendicularly to another panel along a similarly configured stud.

Panel 900, shown in FIG. 9, has a "⋁" or "▽" shaped vertical stud at each vertical edge and may be used for bidirectional intersections with panel edges having similarly configured studs. Interconnection of panels 900 are shown in FIGS. 4 and 21.

As understood from the above description and the FIGURES, construction system 400 includes five basic panel types wherein the location and alignment of the panels permits construction of any type of wall required for the project, without requiring the design or construction of specific additional panels. The configuration, function, joining, and intersection of each of the panels of construction system 400 can be adapted for any type of architectural design. Even atypical areas or irregular forms in the vertical planes can be constructed, such as the formation of angles B other than 90° (angle A) between studs, as shown in FIG. 21.

Because of the unique connection of the free ends of the panels of construction system 400, the central alignment planes of all of the panels are aligned and joined along the vertical edges of the panels. Such alignment is easily observed between panels interconnected with male connection members 520. As shown in FIGS. 4 and 18–21, the central alignment planes of panels joined along "⋁" or "▽" shaped studs 710 are also joined and aligned. In particular, in FIG. 18, central alignment planes 1800 of two panels joined along "⋁" or "▽" shaped studs 710 to form a "⌐" intersection are automatically joined and aligned upon interconnection. Likewise, in FIG. 19, central alignment planes 1900 of three panels joined along "⋁" or "▽" shaped studs 710 to form a "⊢" intersection are automatically joined and aligned upon interconnection. The same is true for central alignment planes 2000 of four studs 710 joined to form a "+" intersection in FIG. 20. Thus, in all of the edifices designed and constructed using the panels of construction system 400, alignment of the panels' central alignment planes will be maintained creating a geometric order in the whole structure which simplifies and regularizes the specific dimensioning in the assembly process, on site. Moreover, the strong one-piece structural panel and its design allows the panels to be used to construct multi-level buildings.

The structural design of the panels of construction system 400 also provides an air cavity 420 between the perimeter studs of the panels' frame. Air cavity 420 permits, when necessary, the installation of any desired insulation material, such as thermal or acoustic insulation, or the air itself can serve as insulation. This option is important because it allows the panels to be adapted to the specific climate condition and budget of the building project. It also provides flexibility with respect to the location of electrical, mechanical, and sanitary installations within the panels, and placement of pipes/tubes and other required vertical elements. The panels are therefore adaptable to a number of internal fixtures and any construction situation, without the need for additional elements, panels, systems, or other different forms of construction.

It will understood that the foregoing is merely illustrative of the principles of the invention, and that various modifications can be made by those skilled in the art without departing from the scope and spirit of the invention. For example, the dimensions, materials, and calibers used in the panels of the present invention, the specific configuration and design of the male connection elements, and the stiffeners may be modified as desired without changing the basic principles of the invention. The described embodiments are presented for the purpose of illustration rather than limitation, and the present invention is limited only by the claims which follow.

What is claimed is:

1. A panel for a prefabricated construction system, said panel comprising:

an upper stud having a first end and a second end;

a lower stud having a first end juxtaposed with said first end of said upper stud and a second end juxtaposed with said second end of said upper stud; and a first vertical stud joining said first juxtaposed ends of said upper and lower studs; wherein said first vertical stud is dimensioned and shaped to be directly interconnected with another stud and has two parallel sides having a pair of juxtaposed free ends and two converging sides joining said juxtaposed free ends and forming a vertex directed away from said parallel sides.

2. The panel of claim 1 wherein said first vertical stud has two parallel sides each having a first end and a second end, a perpendicular side joining said first ends of said two parallel sides and perpendicular to said two parallel sides, and a pair of end segments perpendicularly joined to said second ends of said two parallel sides and parallel to said perpendicular side.

3. A panel for a prefabricated construction system, said panel comprising:

an upper stud having a first end and a second end;

a lower stud having a first end juxtaposed with said first end of said upper stud and a second end juxtaposed with said second end of said upper stud; and a first vertical stud joining said first juxtaposed ends of said upper and lower studs; wherein:

said first vertical stud is dimensioned and shaped to be directly interconnected with another stud, has two parallel sides having a pair of juxtaposed free ends and a perpendicular side joining said juxtaposed free ends and perpendicular to said two parallel sides, and has at least one male connection element positioned on said perpendicular side, facing away from said parallel sides;

said at least one male connection element comprises first and second parallel sides;

said first and second parallel sides of said at least one male connection element are spaced apart a first distance;

said upper and lower studs each comprise two parallel sides having a pair of juxtaposed free ends and a perpendicular side joining said juxtaposed free ends and perpendicular to said two parallel sides; and said two parallel sides of each of said upper and lower studs are spaced apart a second distance greater than said first distance, whereby said first and second sides of said male connection element fit tightly between said first and second sides of said upper and lower studs.

4. The panel of claim 3 wherein each of said upper and lower studs further comprises a pair of end segments perpendicularly joined to said second sides and parallel to said perpendicular sides.

5. A panel for a prefabricated construction system, said panel comprising:

an upper stud having a first end and a second end;

a lower stud having a first end juxtaposed with said first end of said upper stud and a second end juxtaposed with said second end of said upper stud;

a first vertical stud joining said first juxtaposed ends of said upper and lower studs, said first vertical stud being dimensioned and shaped to be directly interconnected with another stud; and a second vertical stud joining said second juxtaposed ends of said upper and lower studs; wherein one of said first and second vertical studs comprises a "V" shaped stud, the vertex pointing away from said upper and lower studs.

6. The panel of claim 5 wherein the other of said first and second vertical studs comprises a "V" shaped stud, the vertex pointing away from said upper and lower studs.

7. A panel for a prefabricated construction system, said panel comprising:

an upper stud having a first end and a second end;

a lower stud having a first end juxtaposed with said first end of said upper stud and a second end juxtaposed with said second end of said upper stud;

a first vertical stud joining said first juxtaposed ends of said upper and lower studs, said first vertical stud being dimensioned and shaped to be directly interconnected with another stud; and a second vertical stud joining said second juxtaposed ends of said upper and lower studs; wherein one of said first and second vertical studs comprises a "V" shaped stud, the vertex pointing away from said upper and lower studs.

8. The panel of claim 6 wherein the other of said first and second vertical studs comprises a "V" shaped stud, the vertex pointing away from said upper and lower studs.

9. The panel of claim 5 wherein the other of said first and second vertical studs comprises a "⊔" shaped stud.

10. The panel of claim 5 wherein the other of said first and second vertical studs comprises a "⊔" shaped stud.

11. The panel of claim 9 wherein said "⊔" shaped stud has at least one male connection element.

12. A panel for a prefabricated construction system, said panel comprising:

an upper stud having a first end and a second end;

a lower stud having a first end juxtaposed with said first end of said upper stud and a second and juxtaposed with said second end of said upper stud;

a first vertical stud joining said first juxtaposed ends of said upper and lower studs, said first vertical stud being dimensioned and shaped to be directly interconnected with another stud; and a second vertical stud joining said second juxtaposed ends of said upper and lower studs; wherein said first and second studs are "⊔" shaped.

13. The panel of claim 12 wherein at least one of said first and second "⊔" shaped studs has at least one male connection element.

14. A stud for a wall panel comprising:

first and second parallel sides spaced apart a first distance, each side having a first end and a second end;

a pair of end segments perpendicularly joined to said second ends of said first and second parallel sides and located within the space created between said first and second parallel sides; and means for connecting said first ends of said first and second parallel sides, said connecting means comprising two converging sides ending at a vertex pointed away from said first and second parallel sides, said connecting means forming a "V", said stud thereby forming a "V" shape.

15. A stud for a wall panel comprising:

first and second parallel sides spaced apart a first distance, each side having a pair of juxtaposed free ends; and means for connecting said pair of juxtaposed free ends of said first and second parallel sides, said connecting means comprising a third side perpendicular to and joining said first and second parallel sides and at least one male connection element positioned on said third side and extending away from said first and second parallel sides; wherein:

said male connection element comprises first and second parallel sides;

said first and second parallel sides of said at least one male connection element are spaced apart a first distance; and said first and second parallel sides of said stud are spaced apart a second distance greater than said first distance, such that said first and second sides of said male connection element can fit tightly between first and second sides of a similarly configured stud.

16. A prefabricated building system comprising;

a plurality of structural panels, each said panel comprising:

an upper stud having a first end and a second end;

a lower stud having a first end juxtaposed with said first end of said upper stud and a second end juxtaposed with said second end of said upper stud; and at least one vertical stud joining one of said first and second juxtaposed ends of said upper and lower studs; wherein:

each said stud has two parallel sides;

each said panel has a central alignment plane;

each said panel is directly interconnected with another panel in said system along one of said juxtaposed ends of said upper and lower studs such that said central alignment planes of said interconnected panels meet at the point of interconnection of said panels;

a first of said plurality of panel types has only one vertical stud;

said one vertical stud comprises two parallel sides having a pair of juxtaposed free ends and a perpendicular side joining said juxtaposed free ends and perpendicular to said two two parallel sides;

the other of said first and second juxtaposed ends are free to be interconnected with studs of another panel; and said vertical stud further comprises a pair of end segments perpendicularly joined to said ends of said two parallel sides and parallel to said perpendicular side.

17. A prefabricated building system comprising:

a plurality of structural panels, each said panel comprising:

an upper stud having a first end and a second end;

a lower stud having a first end juxtaposed with said first end of said upper stud and a second end juxtaposed with said second end of said upper stud; and at least one vertical stud joining one of said first and second juxtaposed ends of said upper and lower studs; wherein:

each said stud has two parallel sides;

each said panel has a central alignment plane;

each said panel is directly interconnected with another panel in said system along one of said juxtaposed ends of said upper and lower studs such that skid central alignment planes of said interconnected panels meet at the point of interconnection of said panels; and each of said upper and lower studs further comprises a pair of end segments perpendicularly joined to said second ends of said two parallel sides and parallel to said perpendicular sides.

18. A prefabricated building system comprising:

a plurality of structural panels, each said panel comprising:

an upper stud having a first end and a second end;

a lower stud having a first end juxtaposed with said first end of said upper stud and a second end juxtaposed with said second end of said upper stud; and at least one vertical stud joining one of said first and second juxtaposed ends of said upper and lower studs; wherein:

each said stud has two parallel sides;

each said panel has a central alignment plane;

each said panel is directly interconnected with another panel in said system along one of said juxtaposed ends of said upper and lower studs such that said central alignment planes of said interconnected panels meet at the point of interconnection of said panels;

a third of said plurality of panel types has only one of said at least one vertical stud;

said vertical stud comprises two parallel sides having a pair of juxtaposed free ends and two converging sides joining said juxtaposed free ends and forming a vertex directed away from said parallel sides; and the other of said first and second juxtaposed ends are free to be interconnected with studs of another panel.

19. A prefabricated building system comprising:

a plurality of structural panels, each said panel comprising:

an upper stud having a first end and a second end;

a lower stud having a first end juxtaposed with said first end of said upper stud and a second end juxtaposed with said second end of said upper stud; and at least one vertical stud joining one of said first and second juxtaposed ends of said upper and lower studs; wherein:

each said stud has two parallel sides;

each said panel has a central alignment plane;

each said panel is directly interconnected with another panel in said system along one of said juxtaposed ends of said upper and lower studs such that said central alignment planes of said interconnected panels meet at the point of interconnection of said panels;

a fourth of said plurality of panel types has a first and a second of said at least one vertical studs;

said first vertical stud joins said first juxtaposed ends;

said second vertical stud joins said second juxtaposed ends; and said first and second vertical studs each comprise two parallel sides having a pair of juxtaposed free ends and two converging sides joining said juxtaposed free ends and forming a vertex directed away from said parallel sides.

20. A prefabricated building system comprising:

a plurality of structural panels, each said panel comprising:

an upper stud having a first end and a second end;

a lower stud having a first end juxtaposed with said first end of said upper stud and a second end juxtaposed with said second end of said upper stud; and at least one vertical stud joining one of said first and second juxtaposed ends of said upper and lower studs; wherein:

each said stud has two parallel sides;

each said panel has a central alignment plane;

each said panel is directly interconnected with another panel in said system along one of said juxtaposed ends of said upper and lower studs such that said central alignment planes of said interconnected panels meet at the point of interconnection of said panels;

a fifth of said plurality of panel types has a first and a second of said at least one vertical studs;

said first vertical stud joins said first juxtaposed ends;

said second vertical stud joins said second juxtaposed ends;

said first vertical stud comprises two parallel sides having a pair of juxtaposed free ends and a perpendicular side joining said juxtaposed free ends and perpendicular to said two parallel sides; and said second vertical stud comprises two parallel sides having a pair of juxtaposed free ends and two converging sides joining said juxtaposed free ends and forming a vertex directed away from said parallel sides.

21. A panel for a prefabricated construction system, said panel comprising:

at least one horizontal stud having two free ends, wherein at least one of said two free ends is dimensioned and shaped to be directly interconnected with another panel; and a vertical stud having two parallel sides having a pair of juxtaposed free ends and two converging sides joining said juxtaposed free ends and forming a vertex directed away from said parallel sides, said vertical stud being joined with said at least one horizontal stud.

22. The panel of claim 21 wherein said interconnections are dimensioned and shaped to form male/female connections with at least one of said horizontal and vertical studs of said other panel.

* * * * *

UNITED STATES PATENT AND TRADEMARK OFFICE

CERTIFICATE OF CORRECTION

PATENT NO. : 5,642,594

DATED : July 1, 1997

INVENTOR(S) : Alfredo Sucre F.

It is certified that error appears in the above-indentified patent and that said Letters Patent is hereby corrected as shown below:

Cover page, under OTHER PUBLICATIONS, 3rd line, change "Pane" to "Panel".

Column 5, line 14, change "nd" to --and--; and line 25, change "surface" to --surfaces--.

Column 6, line 48, after "section" insert --(shown in more detail in FIG. 28A)--.

Column 7, line 20, change "based" to --base--.

Column 9, line 53, change "Of" to --of--.

Column 12, line 64, change "second and" to --second end--.

Column 13, line 67, change "two two" to --two--.

Column 14, line 21, change "skid" to --said--.

Signed and Sealed this

Fourth Day of January, 2000

*Attest:*

*Attesting Officer*

*Acting Commissioner of Patents and Trademarks*